US011464298B2

(12) United States Patent
Kim et al.

(10) Patent No.: US 11,464,298 B2
(45) Date of Patent: Oct. 11, 2022

(54) MULTI AIRTIGHT TYPE RAIL ZIPPER

(71) Applicant: Young Gyo Kim, Busan (KR)

(72) Inventors: Young Gyo Kim, Busan (KR); Young Ae Kim, Busan (KR)

(73) Assignee: Young Gyo Kim, Busan (KR)

( * ) Notice: Subject to any disclaimer, the term of this patent is extended or adjusted under 35 U.S.C. 154(b) by 0 days.

(21) Appl. No.: 16/492,225

(22) PCT Filed: Mar. 9, 2018

(86) PCT No.: PCT/KR2018/002805
§ 371 (c)(1),
(2) Date: Sep. 9, 2019

(87) PCT Pub. No.: WO2018/164525
PCT Pub. Date: Sep. 13, 2018

(65) Prior Publication Data

US 2020/0008542 A1 Jan. 9, 2020

(30) Foreign Application Priority Data

Mar. 9, 2017 (KR) ..... 10-2017-0030190

(51) Int. Cl.
*A44B 19/32* (2006.01)
*A44B 19/08* (2006.01)
*A44B 19/26* (2006.01)

(52) U.S. Cl.
CPC ..... *A44B 19/32* (2013.01); *A44B 19/08* (2013.01); *A44B 19/26* (2013.01)

(58) Field of Classification Search
CPC ..... A44B 19/32; A44B 19/08; A44B 19/26
See application file for complete search history.

(56) References Cited

U.S. PATENT DOCUMENTS 2,641,037 A 6/1953 Gossner
2,910,754 A * 11/1959 Morin ..... A44B 19/32 24/384

(Continued)

FOREIGN PATENT DOCUMENTS

CN 105686241 A 6/2016
KR 20-1985-0000880 Y1 5/1985

(Continued)

OTHER PUBLICATIONS

International Search Report for PCT/KR2018/002805 dated Jun. 7, 2018.

*Primary Examiner* — Victor D Batson
*Assistant Examiner* — Matthew J Sullivan
(74) *Attorney, Agent, or Firm* — The PL Law Group, PLLC

(57) ABSTRACT

A multi airtight type rail zipper may be attached to or installed on a flexible material, such as an envelope, for storing an object. The multi airtight type rail zipper includes a first zipper rail, a second zipper rail formed in a shape corresponding to that of the first zipper rail, and a slider provided to surround the first zipper rail and the second zipper rail such that, according to the direction of sliding movement, the first zipper rail and the second zipper rail engage with and are fastened to each other, or disengage and are unfastened from each other. The multi airtight type rail zipper can improve the sealing force by the more stable fastening structure.

6 Claims, 10 Drawing Sheets

(56) References Cited

U.S. PATENT DOCUMENTS

| | | | | |
|---|---|---|---|---|
| 6,854,886 | B2 * | 2/2005 | Piechocki | B65D 33/2516 24/584.1 |
| 9,896,241 | B2 * | 2/2018 | Anzini | A44B 19/265 |
| 10,080,405 | B2 * | 9/2018 | Cheng | A44B 19/06 |
| 10,144,160 | B2 * | 12/2018 | Cheng | A44B 19/32 |
| 10,362,839 | B2 * | 7/2019 | Minato | A44B 19/26 |
| 2006/0207069 | A1 * | 9/2006 | Cheng | A44B 19/32 24/389 |
| 2010/0303390 | A1 * | 12/2010 | Ackerman | B65D 33/255 383/61.2 |
| 2014/0366336 | A1 * | 12/2014 | Chung | A44B 19/16 24/389 |
| 2018/0078008 | A1 * | 3/2018 | Sturm | A45F 3/04 |

FOREIGN PATENT DOCUMENTS

| | | | |
|---|---|---|---|
| KR | 20-0200162 | Y1 | 10/2000 |
| KR | 20-0322063 | Y1 | 8/2003 |
| KR | 20-2008-0003305 | U | 8/2008 |
| KR | 10-1515143 | B1 | 4/2015 |

* cited by examiner

MULTI AIRTIGHT TYPE RAIL ZIPPER

CROSS REFERENCE TO RELATED APPLICATIONS AND CLAIM OF PRIORITY

This application claims benefit under 35 U.S.C. 119(e), 120, 121, or 365(c), and is a National Stage entry from International Application No. PCT/KR2018/002805, filed Mar. 9, 2018, which claims priority to the benefit of Korean Patent Application No. 10-2017-0030190 filed in the Korean Intellectual Property Office on Mar. 9, 2017, the entire contents of which are incorporated herein by reference.

TECHNICAL FIELD

The present invention relates to a rail zipper, and more specifically, to a multi airtight type rail zipper which is attached to or mounted on a flexible material, such as a bag for storing an object, so that the contents are sealed and stored.

BACKGROUND ART

Generally, when food, medicine, medical goods, and sundries are sealed and packed, zipper bags made of a vinyl material are widely used.

A zipper bag includes a pair of band-shaped zipper tapes formed on an open inlet thereof and interlocked with each other, and the zipper tapes are pressed to be fastened to each other so as to seal an inner space of the zipper bag.

For example, Korean Utility Model Publication No. 20-0200162 "Vinyl Container with Double Zipper" discloses a technology that improves airtightness using double rails that interlock with each other.

However, in the case of the prior art, a user laterally opens the inlet of the zipper bag to take out the contents. In this case, when an excessive force is applied, a situation in which a part of the contents falls out or a vinyl portion is torn occurs frequently.

Further, even when the zipper bag is closed, when a user presses fastening portions of the zipper tapes, which are not aligned appropriately, the sealing is not performed appropriately, and thus dissatisfaction of the user may be caused.

Meanwhile, to solve the problem of the prior art, in Korean Utility Model Publication No. 20-2008-0003305 "Vinyl Case with Vinyl Zipper", a slider for opening and closing the vinyl zipper formed on an inlet of the vinyl case is provided, and thus the inlet of the vinyl case can be easily opened and closed.

Specifically, in the above prior art document, the slider is coupled to the vinyl zipper formed so that male and female portions are interlocked, and the vinyl zipper is opened or closed in a movement direction of the slider, and thus a user can easily open or close the inlet of the vinyl case.

However, in the case of the prior art document, an opening and closing operation is easily performed, but since a fastening surface of the vinyl zipper is linear, the vinyl zipper may be easily deformed by an external force or heat.

That is, in a rail structure of the zipper bag according to the related art, mostly, a projection formed along the inlet is fitted into a recess, which is interlocked with the projection, in a forcible insertion manner while facing the recess in a lateral or vertical direction.

Therefore, when an internal pressure is increased in a sealed state, a pressure is concentrated on a portion that has a relatively weaker fastening force, and a fastening force is released, and thus the sealed state cannot be maintained.

Further, a double rail is provided to increase a sealing force, but a contact surface of the rail is linear, and thus the rail may be easily deformed by heat or an external force. When the rail is deformed, the sealing force is sharply decreased.

SUMMARY

The present invention is directed to providing a multi airtight type rail zipper that allows a sealing rail, a first zipper rail, which includes an upper rail and a lower rail provided on an upper side and a lower side of the sealing rail, and a second zipper rail, which has a structure corresponding to the first zipper rail, to be fastened to each other using a slider to firmly maintain a coupled state so as to increase a sealing force.

One aspect of the present invention provides a multi airtight type rail zipper which includes a first zipper rail, a second zipper rail that has a shape corresponding to the first zipper rail, and a slider provided to surround the first zipper rail and the second zipper rail such that the first zipper rail and the second zipper rail are interlocked and fastened or are unfastened from an interlocked state in a sliding-movement direction, wherein each of the first zipper rail and the second zipper rail includes a sealing rail that has a sealing rail-concave part and a sealing rail-convex part consecutively repeatedly formed, an upper rail that has an upper rail-concave part and an upper rail-convex part consecutively repeatedly formed on an upper side of the sealing rail, and a lower rail that has a lower rail-concave part and a lower rail-convex part consecutively repeatedly formed on a lower side of the sealing rail, and thus the sealing rail-concave part and the sealing rail-convex part of the second zipper rail are fastened to or unfastened from the sealing rail-convex part and the sealing rail-concave part of the first zipper rail in a movement direction of the slider, the upper rail-concave part and the upper rail-convex part of the second zipper rail are fastened to or unfastened from the upper rail-convex part and the upper rail-concave part of the first zipper rail, and the lower rail-convex part and the lower rail-concave part of the second zipper rail are fastened to or unfastened from the lower rail-concave part and the lower rail-convex part of the first zipper rail.

In the first zipper rail and the second zipper rail, at least a part of the upper rail-convex part, the sealing rail-convex part, and the lower rail-convex part may be exposed to the outside when vertically viewed from above or below.

In the first zipper rail and the second zipper rail, central points of the upper rail-concave part, the sealing rail-concave part, and the lower rail-concave part may be formed at different positions.

The upper rail may further include a cover for shielding a fastening position of the upper rail-concave part and the upper rail-convex part.

The first zipper rail and the second zipper rail may be made of a flexible material that is elastically deformable, and a core made of a hard material may be further provided in one or more convex parts of the upper rail-convex part, the sealing rail-convex part, and the lower rail-convex part.

In a multi airtight type rail zipper according to the present invention, a first zipper rail and a second zipper rail, which are fastened to or unfastened from each other by a slider, each includes a sealing rail for sealing performance and upper and lower rails that are formed on an upper side and a lower side of the sealing rail to increase a fastening force and sealing performance. Further, the upper rail, the lower rail, and the sealing rail have convex parts and concave parts that are repeatedly formed so as to increase a contact area while being fastened to each other.

Further, the sealing rail is formed in a rectangular plate shape and has the highest sealing force when fastened, and the upper rail and the lower rail have fastening surfaces with curvatures to be easily fastened to each other and to allow a fastening ability of the sealing rail to be maintained.

Furthermore, in the multi airtight type rail zipper according to the present invention, at least parts of the upper rail-convex part, the sealing rail-convex part, and the lower rail-convex part are formed to be exposed to the outside when vertically viewed from above or below and are sequentially fastened to each other when pressed by a slider.

That is, in the present invention, when the upper rail-convex part positioned on an uppermost side of the multi airtight type rail zipper is first fastened by the slider, the fastening of the sealing rail-convex part proceeds before completion of the fastening of the upper rail-convex part, and a lower rail-convex part is continuously fastened before completion of the fastening of the sealing rail-convex part. In the event of unfastening, the unfastening is performed in reverse order to the fastening process, and thus a user can more easily operate the slider.

Furthermore, formation positions of the upper rail-convex part, the sealing rail-convex part, and the lower rail-convex part do not overlap each other, and central points of an upper rail-concave part, the sealing rail-concave part, and the lower rail-concave part are formed at different positions. Therefore, in a state in which the concave part and the convex part are fastened to each other, even when an internal pressure of a space in which articles are accommodated is increased, a pressurizing force is not concentrated at a specific position but is efficiently distributed, and thus a sealing force can be efficiently maintained.

DETAILED DESCRIPTION

Hereinafter, specific embodiments of the present invention will be described with reference to the accompanying drawings. However, the scope of the present invention is not limited to the suggested embodiments, and those skilled in the art who understand the spirit of the present invention can easily suggest other embodiments within the scope of the same spirit.

Figure 1:
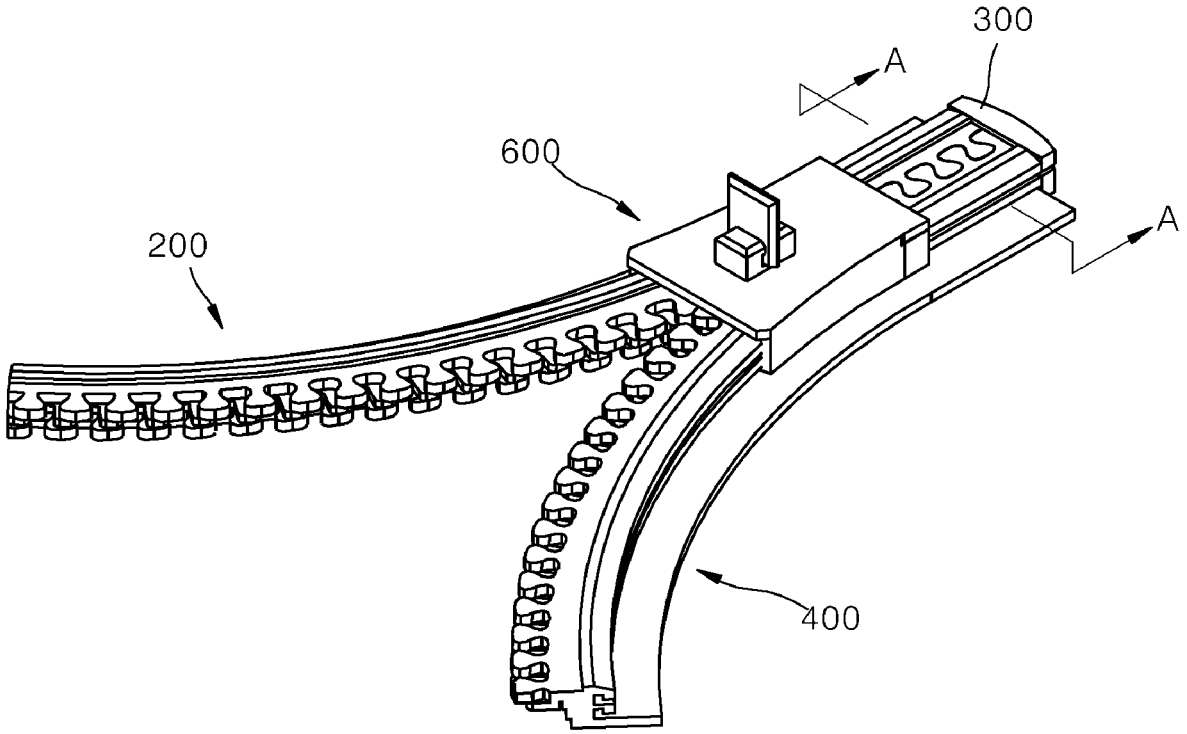
FIG. 1 is a view illustrating a multi airtight type rail zipper according to one embodiment of the present invention.
Figure 2:
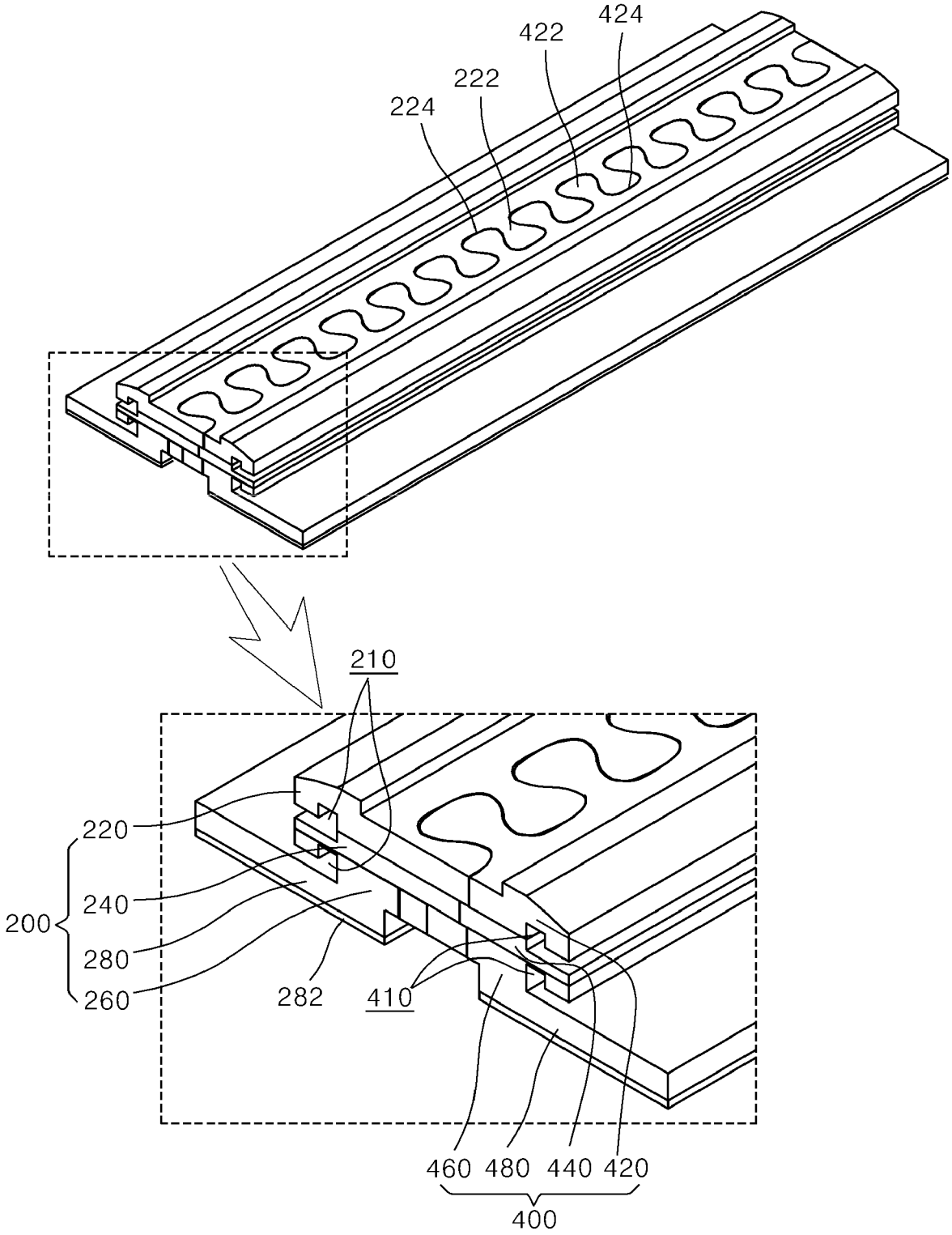
FIG. 2 is a view illustrating a state in which a first zipper rail and a second zipper rail, which are main components of the present invention, are fastened to each other.
Figure 3:
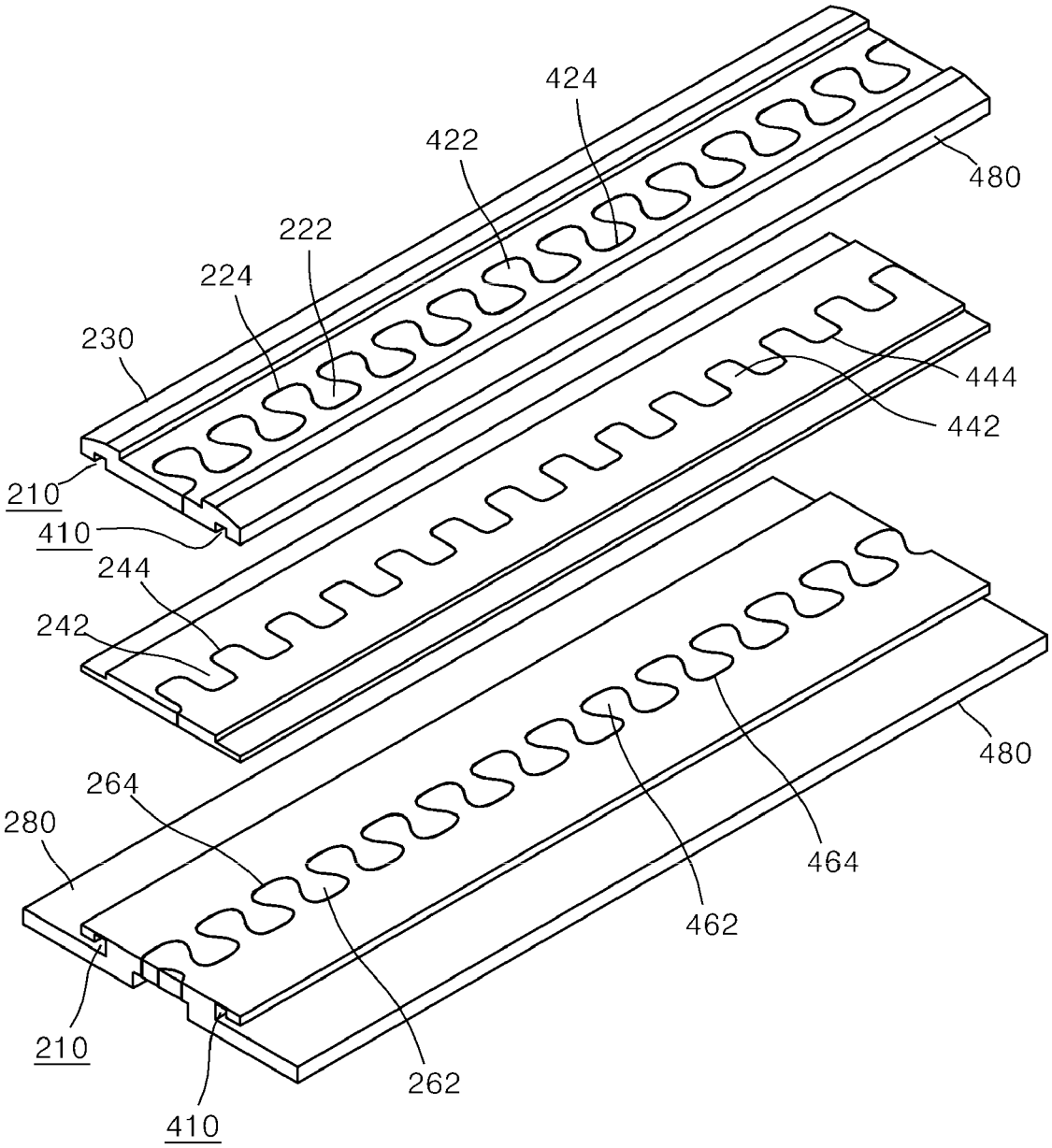
FIG. 3 is an exploded perspective view for describing a layer structure in a state in which the first zipper rail and the second zipper rail that are fastened to each other.

FIG. 1 is a view illustrating a multi airtight type rail zipper according to one embodiment of the present invention, FIG. 2 is a view illustrating a state in which a first zipper rail and a second zipper rail, which are main components of the present invention, are fastened to each other, and FIG. 3 is an exploded perspective view for describing a layer structure in a state in which the first zipper rail and the second zipper rail that are fastened to each other.

Referring to the drawings, in a multi airtight type rail zipper 100, a first zipper rail 200 and a second zipper rail 400, which have shapes corresponding to each other, are interlocked by a slider 600 to be fastened to or unfastened from each other.

The first zipper rail 200 and the second zipper rail 400 are formed to have shapes corresponding to each other and have a multi-layer structure described below.

Specifically, the first zipper rail 200 and the second zipper rail 400 respectively have sealing rails 240 and 440 in which sealing rail-concave parts 244 and 444 and sealing rail-convex parts 242 and 442 are consecutively repeatedly formed, upper rails 220 and 420 which are formed on upper sides of the sealing rails 240 and 440 and in which upper rail-concave parts 224 and 424 and upper rail-convex parts 222 and 422 are consecutively repeatedly formed, and lower rails 260 and 460 which are formed on lower sides of the sealing rails 240 and 440 and in which the lower rail-concave parts 264 and 464 and the lower rail-convex parts 262 and 462 are consecutively repeatedly formed.

That is, a first upper rail 220, a first sealing rail 240, and a first lower rail 260 are formed in order from an upper side of the first zipper rail 200, and the second zipper rail 400 includes a second upper rail 420, a second sealing rail 440, and a second lower rail 460 that are formed in order from the upper side of the second zipper rail 400. Further, a first installation part 280 and a second installation part 480 for installation are further formed under the first lower rail 260 and the second lower rail 460.

Each of the installation parts 280 and 480 may further include an adhesive member 282 that allows the first zipper rail 200 and the second zipper rail 400 to adhere along an open inlet of a vinyl or fabric pocket, and when the adhesive member 282 is not used, the installation parts 280 and 480 may be mounted along the inlet through a heat fusion method and the like.

Further, a first upper rail-guide 230 and a second upper rail-guide 430 are formed on the first upper rail 220 and the second upper rail 420, respectively, and a first guide groove 210 and a second guide groove 410, into which parts of rail protrusions 640 and 660 (see FIG. 9) of the slider 600 are inserted, are further formed on the first upper rail-guide 230 and the second upper rail-guide 430.

Further, the first guide groove 210 and the second guide groove 410 are further formed on the first lower rail 260 and the second lower rail 460, and the remaining portions of the rail protrusions 640 and 660 (see FIG. 9) are inserted, and thus the slider 600 forms a movement path for fastening or unfastening the first zipper rail 200 and the second zipper rail 400.

Meanwhile, the multi airtight type rail zipper 100 according to the present invention is made of a shape-deformable material, such as silicone or flexible plastic, and manufactured in the following form.

Figure 4:
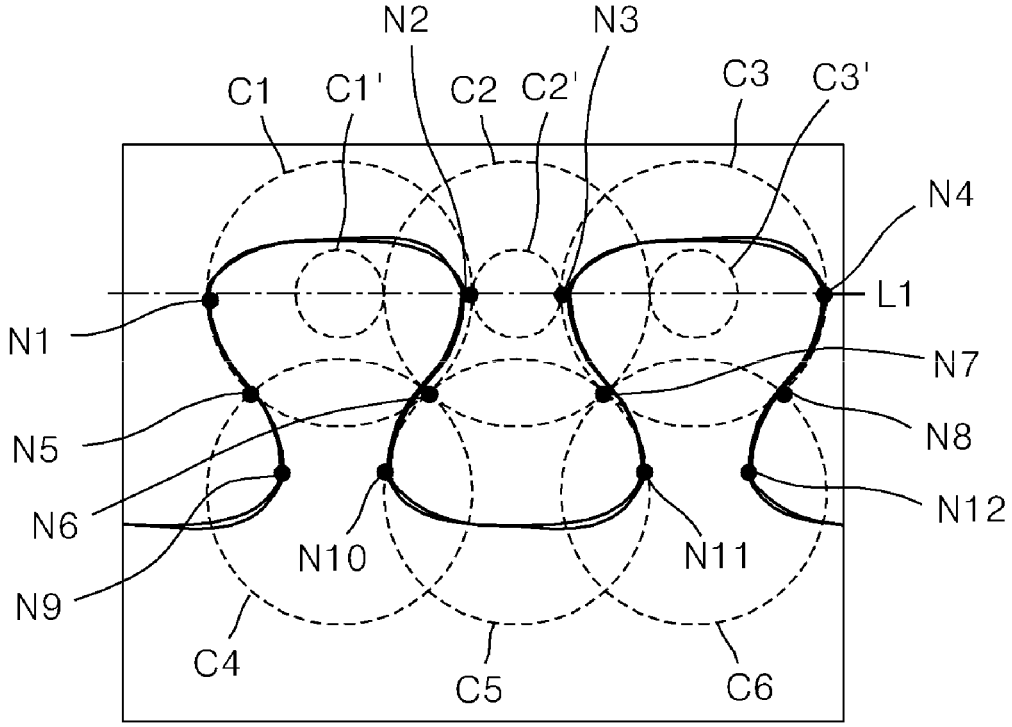
FIG. 4 is a view for describing a process of designing unit cells that constitute an upper rail and a lower rail that are main components of the present invention.
Figure 5:
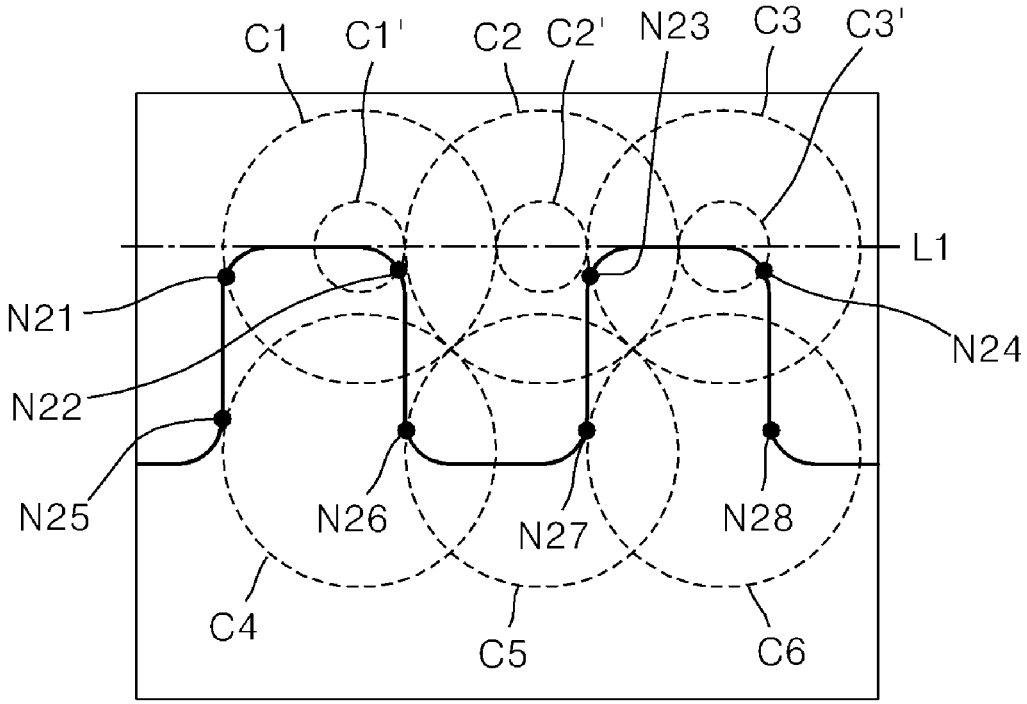
FIG. 5 is a view for describing a process of designing unit cells that constitute a sealing rail that is a main component of the present invention.
Figure 6:
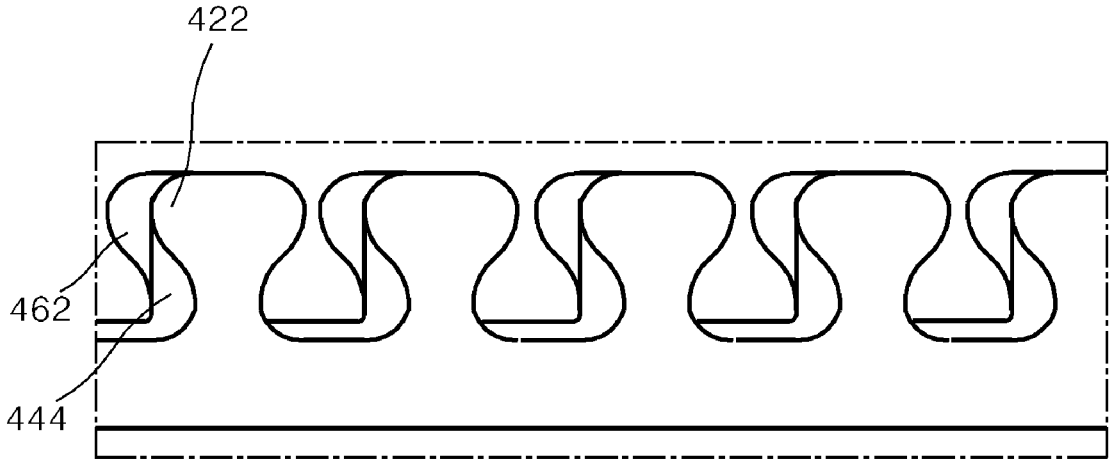
FIGS. 6 and 7 are views for describing the positional relationship of the upper rail, the sealing rail, and the lower rail that are main components of the present invention
Figure 7:
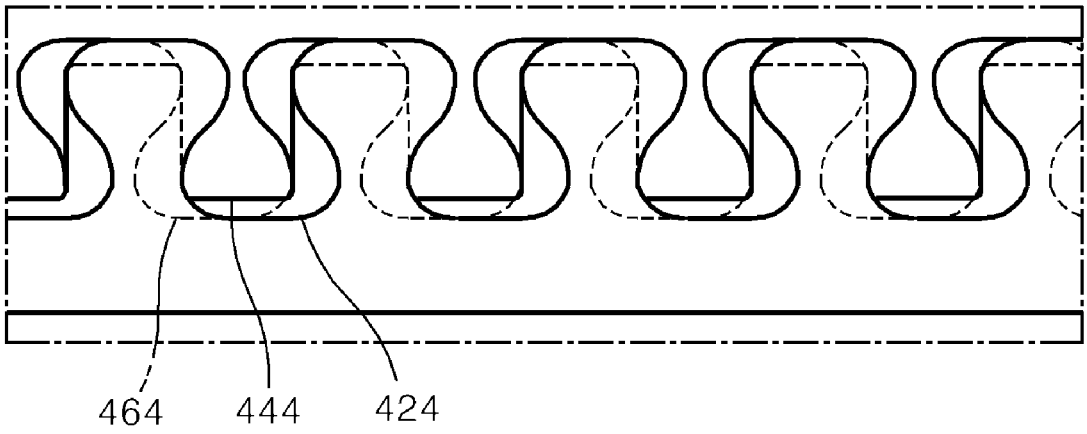

FIG. 4 is a view for describing a process of designing unit cells that constitute an upper rail and a lower rail that are main components of the present invention, FIG. 5 is a view for describing a process of designing unit cells that constitute a sealing rail that is a main component of the present invention, and FIGS. 6 and 7 are views for describing the positional relationship of the upper rail, the sealing rail, and the lower rail that are main components of the present invention.

Prior to the description, in the multi airtight type rail zipper 100 according to the present invention, the first upper rail 220, the first lower rail 260, the second upper rail 420, and the second lower rail 460 are formed as a unit cell having the same shape. The unit cell described in the description is defined as one convex part and one concave part consecutively formed from the convex part, wherein the convex part and the concave part form a rail.

To design the unit cell of the multi airtight type rail zipper 100, a first circle C1 and a first central circle C1' are formed first at the same height as a second circle C2 and a second central circle C2', and a third circle C3 and a third central circle C3' are formed at the same height as the first circular circle C1' as shown in FIG. 4 in the same manner as described above, wherein the first circle C1 has a predetermined diameter, a diameter of the first central circle C1' is ⅓ of a diameter of the first circle C1, the second circle C2 is in contact with the first central circle C1', a diameter of the first central circle C2' is ⅓ of a diameter of the first circle C2, and the third circle C3 is in contact with the second circular circle C2'.

As described above, when the first to third circles C1, C2, C3 are formed parallel to the first to third central circles C1', C2', C3', a center line L1 that connects centers of the first to third central circles C1', C2', C3' is formed, and fourth to sixth circles C4, C5, C6 are further formed below the first to third circles C1, C2, and C3 as shown in FIG. 4.

In this case, the fourth to sixth circles C4, C5, C6, although not shown in the drawings, are formed in the same manner as the first to third circles C1, C2, C3, and a central circle and a center line can be shown, and circles and central circles that have the same sizes are repeatedly formed on a left side of the fourth circle C4 and a right side of the sixth circle C6.

Meanwhile, a plurality of nodes are formed on the first to sixth circles C1 to C6, and in the present invention, a convex part and a concave part are designed using the nodes.

Specifically, as shown in FIG. 4, the nodes for designing the convex part and the concave part are formed as first to twelfth nodes N1 to N12, and each of the nodes form inflection points of the convex part or the concave part.

First, when the convex part is formed, an arc that connects the shown first node N1 and the second node N2 is formed. When the arc is formed, the arc passes through one point on the first circular circle C1', and thus a size of arc is determined.

Meanwhile, when the arc is formed as described above, a left side of the arc is connected down to the fifth node N5 along the first circle C1. Although not shown, the fifth node N5 is connected to the ninth node N9 along any circle positioned to cross the fourth circle C4.

Further, the right side of the arc is connected from the second node N2 to the sixth node N6 downward along the first circle C1, and the sixth node N6 is connected to the tenth node N10 along the fifth circle C5, and thus the convex part is formed.

Further, the concave part is formed subsequently from the convex part formed as described above.

Similar to the formation process of the arc of the above-described convex part, an arc of the concave part is formed by connecting the tenth node N10 and the eleventh node N11. Further, the eleventh node N11 is connected up to the seventh node N7 along the firth circle C5, and the seventh node N7 is connected to the third node N3 along the third circle C3, and thus the concave part is formed, and the unit cell is formed.

Further, when the unit cells formed as described above are repeatedly formed, upper rails 220 and 420 are formed, and lower rails 260 and 460 are formed by moving the upper rails 220 and 420, which are formed as described above, to the left or right by a diameter of the first central circle C1'.

That is, the upper rails 220 and 420 are formed to have a shape corresponding to the lower rails 260 and 460 through the same designing process and have a position moved from the lower rails 260 and 460 by a predetermined distance. Therefore, the upper rails 220 and 420 do not entirely overlap the lower rails 260 and 460 on a vertical line, and predetermined portions of the upper rails 220 and 420 are exposed to the outside.

Meanwhile, the sealing rails 240 and 440 formed between the upper rails 220 and 420 and the lower rails 260 and 460 are designed using other nodes formed on the above-described first to sixth circles C1 to C6.

In FIG. 5, twenty-first to twenty-eighth nodes N21 to N28 are formed on the first to sixth circles C1 to C6, and the nodes form inflection points of the convex part or the concave part.

Specifically, the twenty-first to twenty-fourth nodes N21 to N24, which are formed on the first circle C1, the second circle C2, and the third circle C3 based on the center line L1, may be formed on nodes of each of the circles and the center line L1, but may be formed at positions moved a predetermined distance downward from the center line L1 to form a curvature at an edge portion of the convex part or the concave part.

Further, although not shown, twenty-fifth to twenty-eighth nodes N25 to N28 are formed on the fourth circle C4, the fifth circle C5, the sixth circle C6, and an arbitrary circle, which is formed subsequently from the sixth circle C6, at positions moved a predetermined distance upward from a straight line that connects centers of the fourth circle C4, the fifth circle C5, and the sixth circle C6.

As described above, when the nodes are formed, the twenty-fifth node N25 positioned on the fourth circle C4 is connected to the twenty-first node N21 positioned on the first circle C1, the twenty-first node N21 is connected to the twenty-second node N22 positioned on the second circle C2 along the center line L1, and the twenty-second node N22 is connected down to the twenty-sixth node N26 positioned on the fifth circle C5, and thus a sealing rail-convex part is formed.

Further, the twenty-sixth node N26 is subsequently connected to the twenty-seventh node N27 positioned on the sixth circle C6, and the twenty-seventh node N27 is connected to the twenty-third node N23, and thus a sealing rail-concave part is formed.

Meanwhile, the sealing rails 240 and 440 formed as described above are positioned in a middle portion of a region that is formed by the upper rails 220 and 420 and the lower rails 260 and 460.

Therefore, as shown in FIG. 6, on a vertical line, the second upper rail-convex part 422, the second sealing rail-convex part 442, and the second lower rail-convex part 462 are not shielded by a component positioned at least on upper sides thereof when vertically viewed from above or below, but are partially exposed to the outside.

Further, as shown in FIG. 7, since central portions of the second upper rail-concave part 424, the second sealing rail-concave part 444, and the second lower rail-concave part 464 do not overlap each other, the convex parts of the second upper rail 420, the second sealing rail 440, and the second lower rail 460 are sequentially fastened to the concave parts thereof, and thus, when the slider 600 is moved, a force required for fastening is decreased, and the convex parts are more easily fastened to the concave parts.

Meanwhile, in another embodiment of the present invention, the sealing rails 240 and 440 may be formed in a structure described below to reinforce the strength of the sealing rails 240 and 440.

Figure 8:
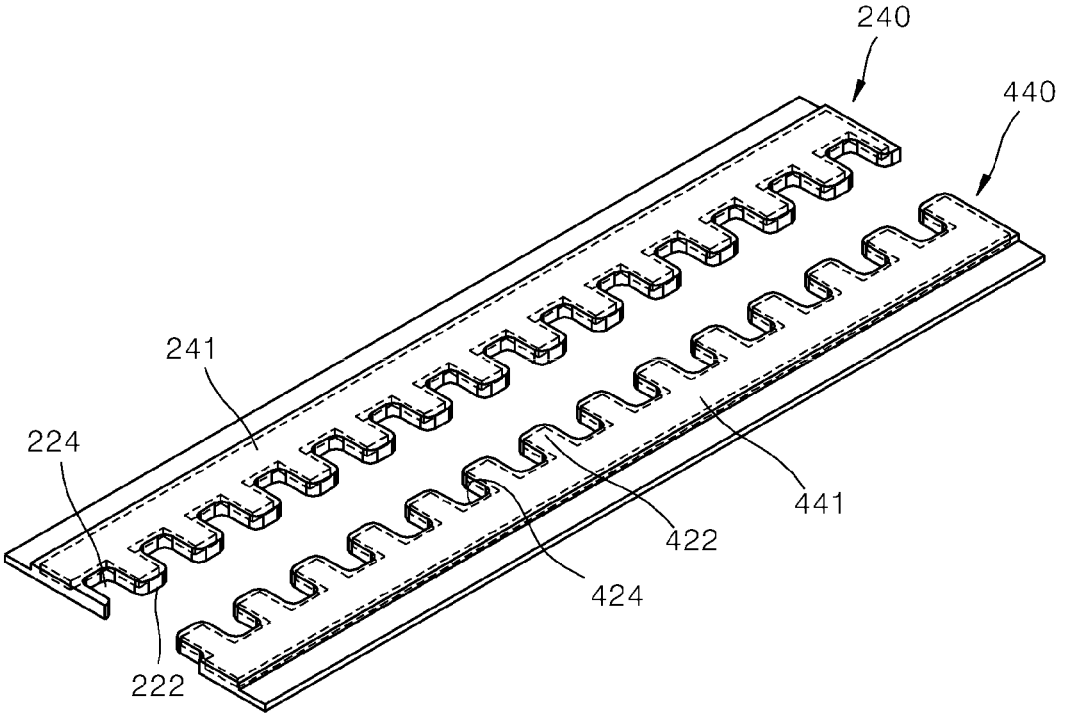
FIG. 8 is a view illustrating sealing rails that are main components according to another embodiment of the present invention.

FIG. 8 is a view illustrating sealing rails that are main components according to another embodiment of the present invention.

Referring to the drawing, in the embodiment, the first sealing rail 240 includes a first convex part 242 and a first concave part 244 that are made of a hard material and accommodate a first core 241, and the second sealing rail 440 includes the second convex part 442 and the second concave part 444 that accommodate a second core 441.

Therefore, when the first sealing rail 240 and the second sealing rail 440 are interlocked and fastened to each other by the slider 600, a more firmly coupled structure of the first core 241 and the second core 441 may be maintained.

Further, although not shown, a structure of the convex part may also be applied to both the upper rails 220 and 420 and the lower rails 260 and 460.

Figure 9:
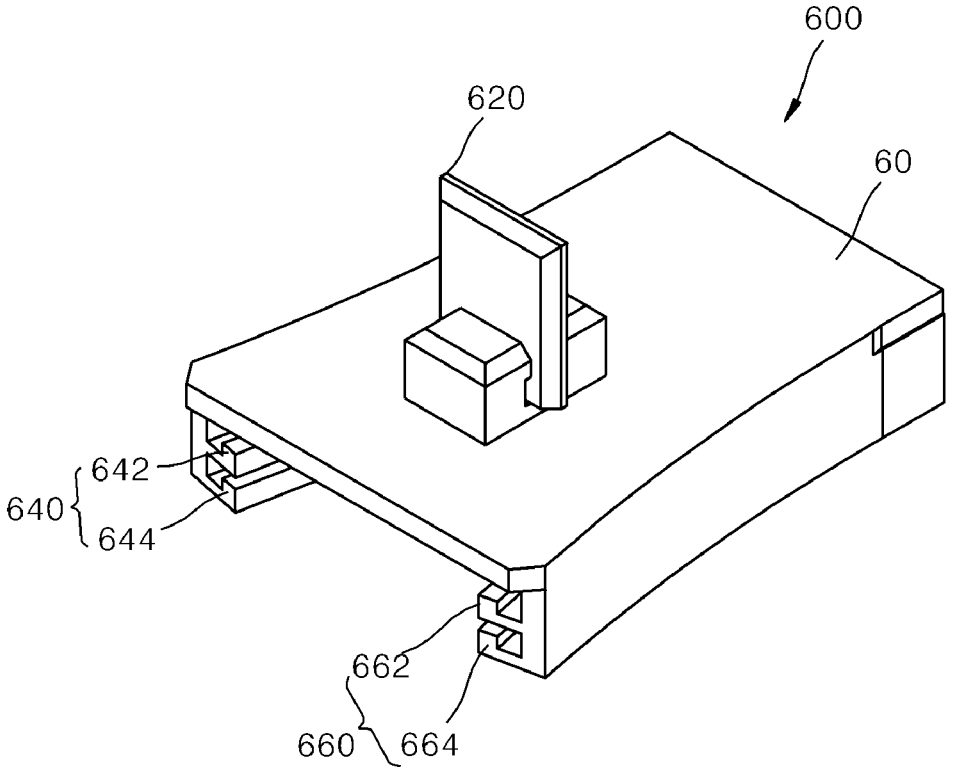
FIGS. 9 and 10 are views illustrating a detailed structure of a slider that is a main component of the present invention.
Figure 10:
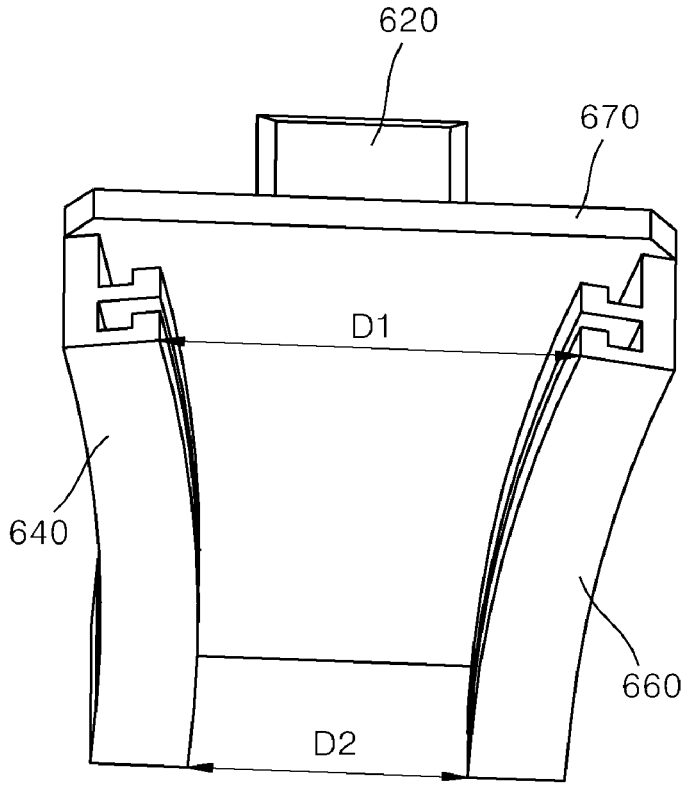

Meanwhile, FIGS. 9 and 10 are views illustrating a detailed structure of the slider that is a main component of the present invention.

Referring to the drawings, a slider 600 includes a slider body 610 that forms a frame of the slider 600, a grip 620 that is provided above the slider body 610, and rail protrusions 640 and 660 that are provided below the slider body 610.

Specifically, in the embodiment, the slider body 610 includes a front side having a relatively wide width and a rear side having a narrower width than the front side.

Further, the rail protrusions 640 and 660 are formed along left and right lower surfaces of the slider body 610 formed as described above. For convenience of description, a left side of the slider body 610 is referred to as a first rail protrusion 640, and a right side thereof is referred to as a second rail protrusion 660.

The first rail protrusion 640 has a shape corresponding to the first guide groove 210 formed in the first zipper rail 200 and, as shown in FIG. 9, includes a first upper rail protrusion 642 that corresponds to the first upper rail 220 and a first lower rail protrusion 644 that corresponds to the first lower rail 260.

Further, the second rail protrusion 660 has a shape corresponding to the second guide groove 410 formed in the second zipper rail 400 and, as shown in FIG. 9, includes the upper rail protrusion 662 and the second lower rail protrusion 664.

Meanwhile, front sides of the first rail protrusion 640 and the second rail protrusion 660 are bent outward from the middle of the slider body 610 according to a shape of the slider body 610, a width between the front sides is equal to a relatively wide width D1, and a width between the rear sides is equal to a relatively narrow width D2.

In this case, the width D2 of the rear side corresponds to a width of the fastened first zipper rail 200 and second zipper rail 400, and the width D1 of the front side is formed greater than the width D2 or a width of at least any one of the convex parts of the upper rails 220 and 420, the sealing rails 240 and 440, and the lower rails 260 and 460.

Therefore, when the slider 600 having the above structure is coupled to the first zipper rail 200 and the second zipper rail 400 and moved, wherein one ends of the first zipper rail 200 and the second zipper rail 400 face each other using stops 300, a fastening force is applied to the first zipper rail 200 and the second zipper rail 400 when the first zipper rail 200 and the second zipper rail 400 pass completely through a rear side of the slider 600 in a movement direction, and the fastening force is released when the first zipper rail 200 and the second zipper rail 400 pass completely through a front side thereof.

The stops 300 may be formed to surround end portions of the first zipper rail 200 and the second zipper rail 400 to maintain a state, in which the first zipper rail 200 is coupled to the second zipper rail 400, and may be mounted on both a starting point and an ending point of movement of the slider 600.

That is, in the multi airtight type rail zipper 100 according to the present invention, both the slider 600 and the stops 300 may be formed to be attachable or detachable, and after the first zipper rail 200 is fastened to the second zipper rail 400, the slider 600 is removed, and thus the fastening-starting point and the fastening-ending point can be finished by the stops 300.

Meanwhile, the multi airtight type rail zipper 100 according to the present invention may also be formed in the following form.

Figure 11:
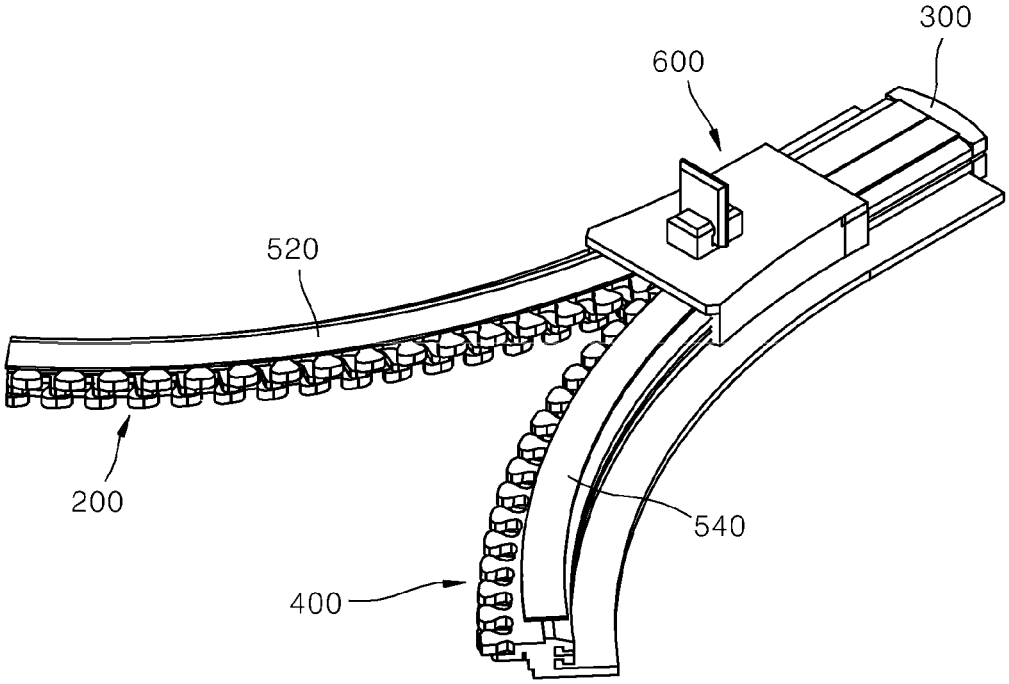
FIGS. 11 and 12 are views showing a multi airtight type rail zipper according to another embodiment of the present invention.
Figure 12:
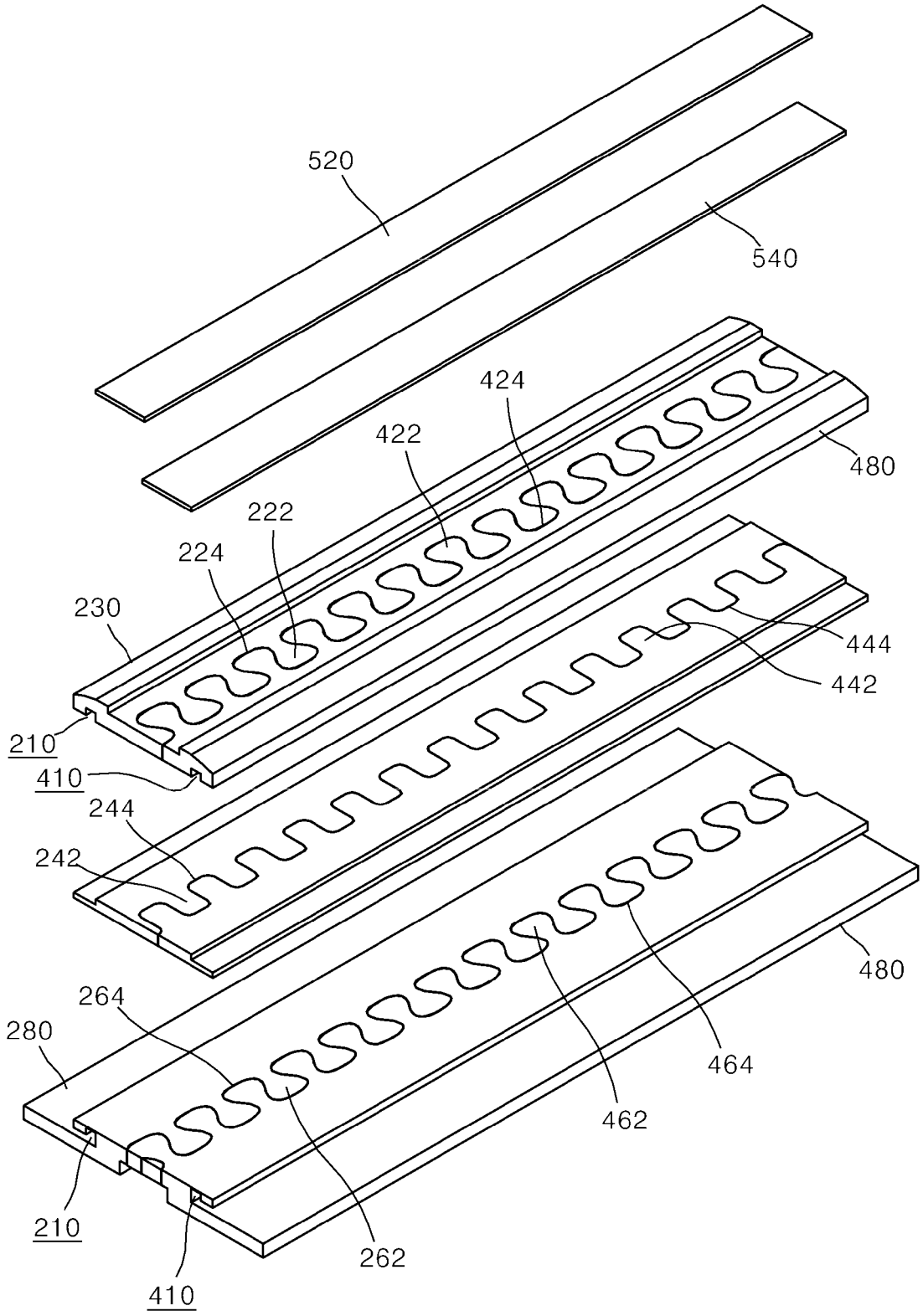

FIGS. 11 and 12 are views showing a multi airtight type rail zipper according to another embodiment of the present invention.

In the embodiment of the present invention, covers 520 and 540 may be further formed on the upper rails 220 and 420 according to the above-described embodiment to prevent foreign matter from being introduced into a fastening portion of the zipper rails.

The covers 520 and 540 may be formed in a band shape having a size that shields the convex part and the concave part along upper rail-guides 230 and 430 and may be formed of a flexible material such as silicone.

Further, although not shown, covers may be further formed on a lower side of the lower rails 260 and 460 in a band shape having a size that shields the convex part and the concave part to prevent foreign matter from being introduced into an enclosed space.

Meanwhile, the multi airtight type rail zipper according to the present invention is attached to an edge of an open inlet of an easily shape-deformable flexible material, such as a bag or a fabric pocket, an opening, which is formed by cutting one surface for the opening, or the like to selectively seal a space for accommodating contents.

Figure 13:
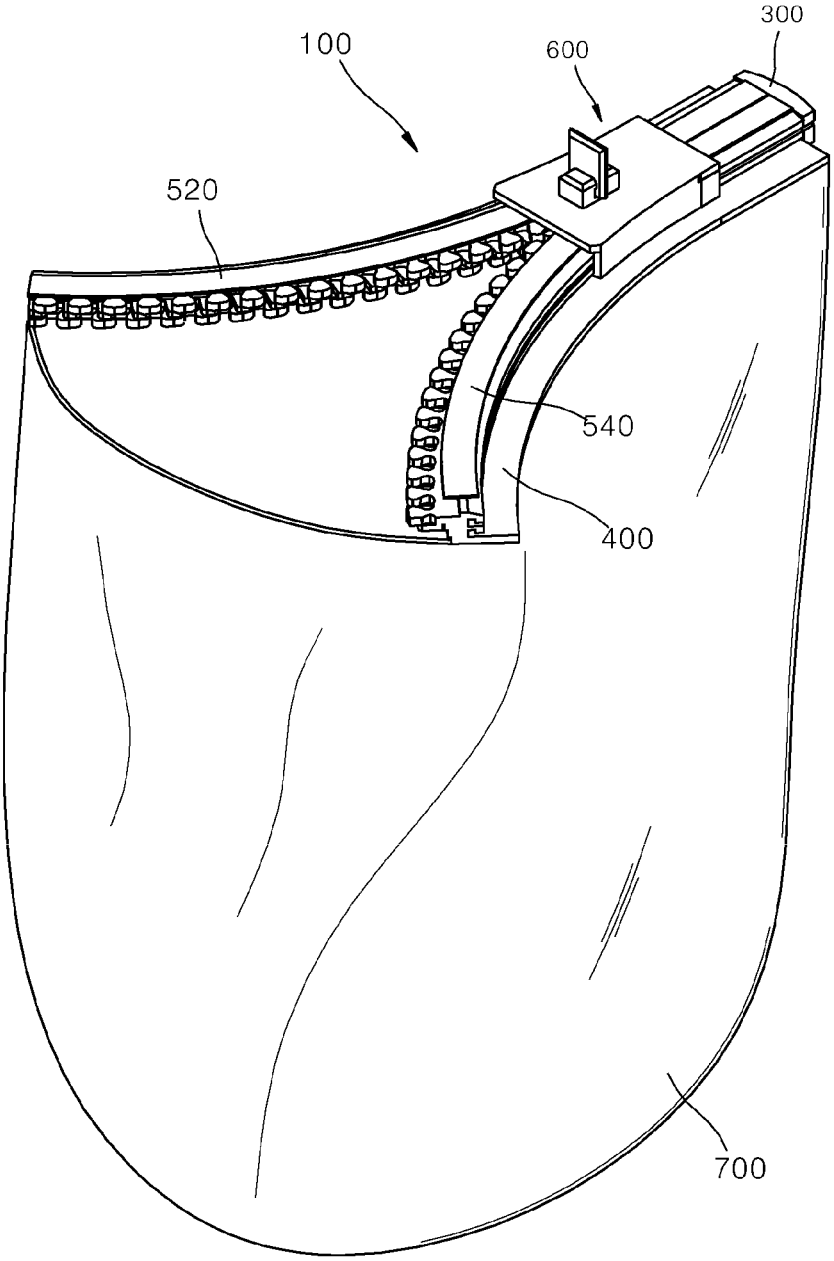
FIG. 13 is a view illustrating an application example of the multi airtight type rail zipper according to the present invention.
Figure 14:
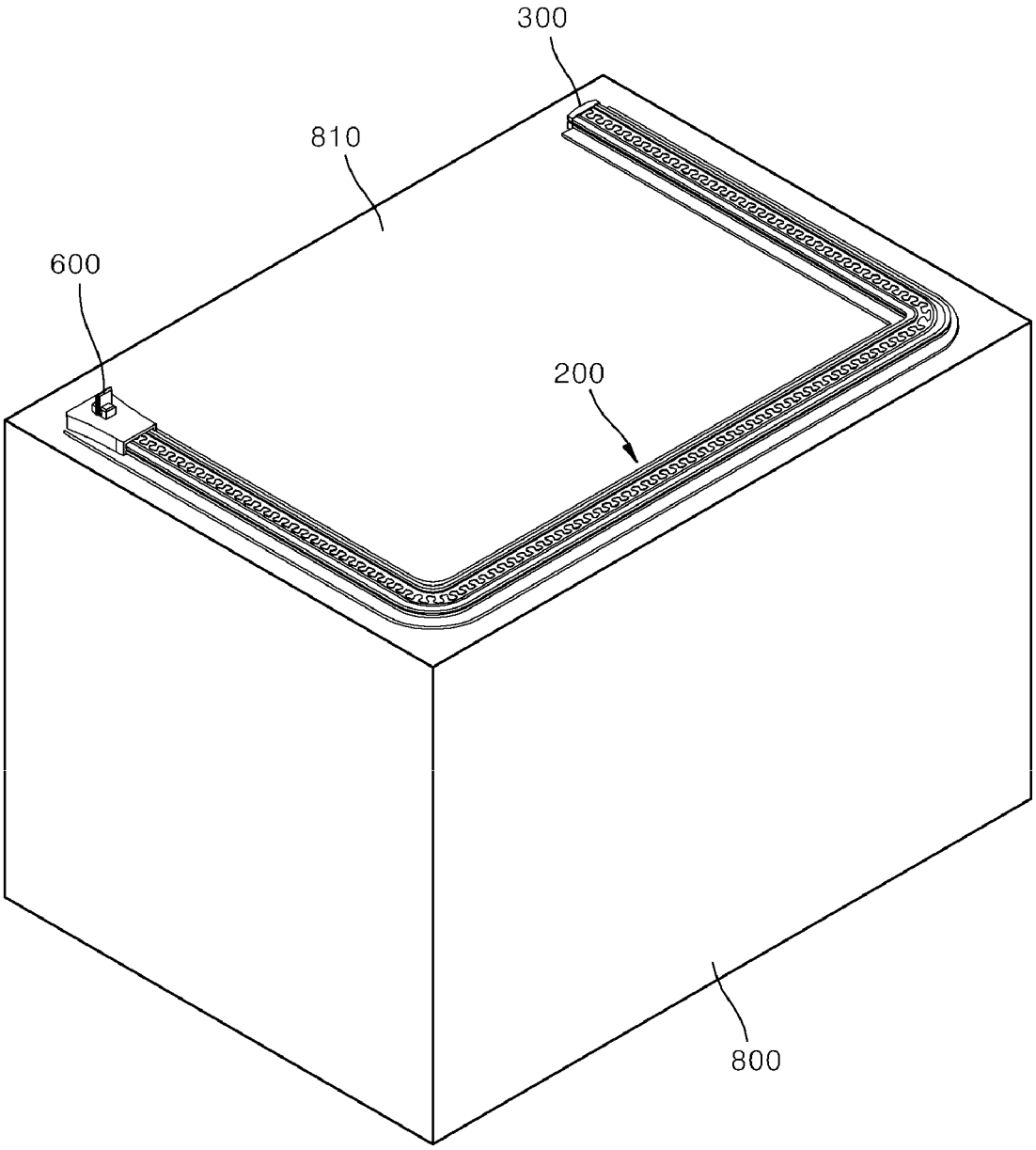
FIG. 14 is a view illustrating another application example of the multi airtight type rail zipper according to the present invention.

FIG. 13 is a view illustrating an application example of the multi airtight type rail zipper according to the present invention, and FIG. 14 is a view illustrating another application example of the multi airtight type rail zipper according to the present invention.

In FIG. 13 which shows an example in which the multi airtight type rail zipper 100 according to the present invention is applied to a vinyl bag 700, the stops 300 are positioned at upper end portions of an opening of the vinyl bag 700, a first installation part 280 is attached to one surface of the opening, and a second installation part 480 is attached to the other surface thereof.

When the first zipper rail 200 and the second zipper rail 400 are attached to the vinyl bag 700 through the above process, the slider 600 is mounted and moved, and thus the first zipper rail 200 is fastened to the second zipper rail 400. Further, when the first zipper rail 200 is fastened to the second zipper rail 400, the slider 600 is separated, and end portions of the first zipper rail 200 and the second zipper rail 400 are finished by the stops 300, and thus the vinyl bag 700 is sealed and stores contents.

Further, although not shown, when the first zipper rail 200 and the second zipper rail 400, which are fastened to each other and have the stops 300 mounted on both ends thereof in advance, are attached to the opening of the vinyl bag 700, only the slider 600 is mounted, and thus an opening and closing operation may be performed.

Meanwhile, in FIG. 14 that shows the multi airtight type rail zipper applied to a fabric box 800, an upper surface of the box 800 is cut in a "□"-shape, and the first installation part 280 and the second installation part 480 are attached along the cut portion.

In the multi airtight type rail zipper 100 applied to the above embodiment, while the slider 600 is moved from the stop 300, a fastening force is applied to the first zipper rail 200 and the second zipper rail 400, and the upper rail 220, the sealing rail 240, and the lower rail 260 are sequentially consecutively fastened to the upper rail 420, the sealing rail 440, and the lower rail 460 with a time gap.

Further, after the fastening, a sealing force is applied to the sealing rails 240 and 440, the upper rails 220 and 420, and the lower rails 260 and 460, and a fastening force is firmly maintained, and thus sealing performance can be increased, wherein the sealing rails 240 and 440 have a plate shape, and the upper rails 220 and 420 and the lower rails 260 and 460 are provided on upper and lower sides of the sealing rails 240 and 440.

Furthermore, when a user presses a space in which contents are accommodated, an internal pressure is concentrated at a specific position. Even in this case, since fastening points of the upper rails 220 and 420, the sealing rails 240 and 440, and the lower rails 260 and 460 do not overlap each other, the multi airtight type rail zipper 100 according to the present invention efficiently distributes a concentrated pressure and firmly maintains a coupled state.

Meanwhile, when the coupled state is released and the accommodated contents are taken out of the space, the slider 600 is moved toward the stop 300, and fastening forces of the first zipper rail 200 and the second zipper rail 400 may be easily released, and thus a user can more easily store the contents for use in a sealed manner.

The invention claimed is:

1. A multi airtight type rail zipper comprising:

a first zipper rail;

a second zipper rail that has a shape corresponding to the first zipper rail; and a slider provided to surround the first zipper rail and the second zipper rail such that the first zipper rail and the second zipper rail are interlocked and fastened or are unfastened from an interlocked state in a sliding-movement direction, wherein each of the first zipper rail and the second zipper rail comprises:

a sealing rail in which a sealing rail-concave part and a sealing rail-convex part are consecutively repeatedly formed, wherein the sealing rail-concave part and the sealing rail-convex part of the second zipper rail are fastened to or unfastened from the sealing rail-convex part and the sealing rail-concave part of the first zipper rail in a movement direction of the slider;

an upper rail in which upper unit cells each of which has an upper rail-concave part and an upper rail-convex part are consecutively repeatedly formed on an upper side of the sealing rail, wherein the upper rail-concave part and the upper rail-convex part of the second zipper rail are fastened to or unfastened from the upper rail-convex part and the upper rail-concave part of the first zipper rail; and a lower rail in which lower unit cells each of which has a lower rail-concave part and a lower rail-convex part are consecutively repeatedly formed on a lower side of the sealing rail, wherein the lower rail-convex part and the lower rail-concave part of the second zipper rail are fastened to or unfastened from the lower rail-concave part and the lower rail-convex part of the first zipper rail, wherein each of the upper unit cell and the lower unit cell is shaped in a manner defined by:

a first circle and a first central circle are formed, wherein a diameter of the first central circle which is positioned in the center of the first circle is ⅓ of a diameter of the first circle;

a second circle and a second central circle are formed, wherein the second circle is in tangential contact with the first central circle, and a diameter of the second central circle which is positioned in a center of the second circle is ⅓ of a diameter of the second circle;

a third circle and a third central circle are formed, wherein the third circle is in tangential contact with the second central circle which is positioned in a center of the third circle, and a first center line connecting the centers of the first circle, the second circle and the third circle is linear;

a fourth circle in intersecting contact with a fifth circle which is in intersecting contact with a sixth circle and a second center line upon which the fourth, fifth and sixth circles are centered, the second center line is parallel to and offset from the first center line at a distance less than or equal to a sum of a radius of the first circle and a radius of the fourth circle; the first circle, second circle, third circle, fourth circle, fifth circle and sixth circle have the same diameter;

nodes are formed on the first to sixth circles to form inflections points of a convex part or a concave part, wherein nodes comprising:

a first node at which the first circle and the first center line intersect;

a second node at which the first circle, the first center line and the second center circle intersect;

a third node at which the second circle, the first center line and the third center circle intersect;

a fourth node at which the third circle and the first center line intersect;

a fifth node at which the first circle and the fourth circle intersect;

a sixth node at which the first circle, the second circle, the fourth circle and the fifth circle intersect;

a seventh node at which the second circle, the third circle, the fifth circle and the sixth circle intersect;

an eighth node at which the third circle and the sixth circle intersect;

a ninth node inside the fourth circle, the ninth node to which the fifth node is connected;

a tenth node on a part of the fifth circle positioned inside of the fourth circle;

an eleventh node on a part of the fifth circle positioned inside of the sixth circle; and a twelfth node inside the sixth circle, the twelfth node to which the eight node is connected, wherein the first to fourth nodes are collinear on the first center line, the fifth to eighth nodes are collinear on the second center line, and an imaginary line connecting the seventh to twelfth nodes is linear, and the first to fourth nodes, the fifth to eighth nodes, and the seventh to twelfth nodes are parallel to each other;

the convex part is formed to form the upper unit cell, the convex part comprises a first convex part and a second convex part, wherein:

the first convex part is formed by forming a first arc that connects the first node and the second node, the first arc is connected down to the fifth node along the first circle, and the fifth node is connected to the ninth node; and the second convex part is formed by forming a second arc that connects the third node and the fourth node, the second arc is connected from the second node to the sixth node downward along the first circle, and the sixth node is connected to the tenth node along the fifth circle; and the concave part is formed to form the lower unit cell by forming a third arc connecting the tenth node and the eleventh node which is connected to the seventh node along the fifth circle, and the seventh node is connected to the third node along the third circle; and wherein, in the first zipper rail and the second zipper rail, at least a part of the upper rail-convex part, the sealing rail-convex part, and the lower rail-convex part are exposed to an outside when vertically viewed from above or below.

2. A multi airtight type rail zipper comprising:

a first zipper rail;

a second zipper rail that has a shape corresponding to the first zipper rail; and a slider provided to surround the first zipper rail and the second zipper rail such that the first zipper rail and the second zipper rail are interlocked and fastened or are unfastened from an interlocked state in a sliding-movement direction, wherein each of the first zipper rail and the second zipper rail comprises:

a sealing rail in which a sealing rail-concave part and a sealing rail-convex part are consecutively repeatedly formed, wherein the sealing rail-concave part and the sealing rail-convex part of the second zipper rail are fastened to or unfastened from the sealing rail-convex part and the sealing rail-concave part of the first zipper rail in a movement direction of the slider;

an upper rail in which upper unit cells each of which has an upper rail-concave part and an upper rail-convex part are consecutively repeatedly formed on an upper side of the sealing rail, wherein the upper rail-concave part and the upper rail-convex part of the second zipper rail are fastened to or unfastened from the upper rail-convex part and the upper rail-concave part of the first zipper rail; and a lower rail in which lower unit cells each of which has a lower rail-concave part and a lower rail-convex part are consecutively repeatedly formed on a lower side of the sealing rail, wherein the lower rail-convex part and the lower rail-concave part of the second zipper rail are fastened to or unfastened from the lower rail-concave part and the lower rail-convex part of the first zipper rail, wherein each of the upper unit cell and the lower unit cell is shaped in a manner defined by:

a first circle and a first central circle are formed, wherein a diameter of the first central circle which is positioned in the center of the first circle is ⅓ of a diameter of the first circle;

a second circle and a second central circle are formed, wherein the second circle is in tangential contact with the first central circle, and a diameter of the second central circle which is positioned in a center of the second circle is ⅓ of a diameter of the second circle;

a third circle and a third central circle are formed, wherein the third circle is in tangential contact with the second central circle which is positioned in a center of the third circle, and a first center line connecting the centers of the first circle, the second circle and the third circle is linear;

a fourth circle, a fifth circle, a sixth circle and a second center line are formed, in the same way as the first to third circles and the first center line are formed, below the first to third circles;

nodes are formed on the first to sixth circles to form inflections points of a convex part or a concave part, wherein nodes comprising:

a first node at which the first circle and the first center line intersect;

a second node at which the first circle, the first center line and the second center circle intersect;

a third node at which the second circle, the first center line and the third center circle intersect;

a fourth node at which the third circle and the first center line intersect;

a fifth node at which the first circle and the fourth circle intersect;

a sixth node at which the first circle, the second circle, the fourth circle and the fifth circle intersect;

a seventh node at which the second circle, the third circle, the fifth circle and the sixth circle intersect;

an eighth node at which the third circle and the sixth circle intersect;

a ninth node inside the fourth circle, the ninth node to which the fifth node is connected;

a tenth node on a part of the fifth circle positioned inside of the fourth circle;

an eleventh node on a part of the fifth circle positioned inside of the sixth circle; and a twelfth node inside the sixth circle, the twelfth node to which the eight node is connected, wherein the first to fourth nodes are collinear on the first center line the fifth to eighth nodes are collinear on the second center line, and an imaginary line connecting the seventh to twelfth nodes is linear, and the first to fourth nodes, the fifth to eighth nodes, and the seventh to twelfth nodes are parallel to each other;

the convex part is formed to form the upper unit cell, the convex part comprises a first convex part and a second convex part, wherein:

the first convex part is formed by forming a first arc that connects the first node and the second node, the first arc is connected down to the fifth node along the first circle, and the fifth node is connected to the ninth node; and the second convex part is formed by forming a second arc that connects the third node and the fourth node, the second arc is connected from the second node to the sixth node downward along the first circle, and the sixth node is connected to the tenth node along the fifth circle; and the concave part is formed to form the lower unit cell by forming a third arc connecting the tenth node and the eleventh node which is connected to the seventh node along the fifth circle, and the seventh node is connected to the third node along the third circle; and wherein, in the first zipper rail and the second zipper rail, central portions of the upper rail-concave part, the sealing rail-concave part, and the lower rail-concave part are formed at different positions.

3. A multi airtight type rail zipper comprising:

a first zipper rail;

a second zipper rail that has a shape corresponding to the first zipper rail; and a slider provided to surround the first zipper rail and the second zipper rail such that the first zipper rail and the second zipper rail are interlocked and fastened or are unfastened from an interlocked state in a sliding-movement direction, wherein each of the first zipper rail and the second zipper rail comprises:

a sealing rail in which a sealing rail-concave part and a sealing rail-convex part are consecutively repeatedly formed, wherein the sealing rail-concave part and the sealing rail-convex part of the second zipper rail are fastened to or unfastened from the sealing rail-convex part and the sealing rail-concave part of the first zipper rail in a movement direction of the slider;

an upper rail in which upper unit cells each of which has an upper rail-concave part and an upper rail-convex part are consecutively repeatedly formed on an upper side of the sealing rail, wherein the upper rail-concave part and the upper rail-convex part of the second zipper rail are fastened to or unfastened from the upper rail-convex part and the upper rail-concave part of the first zipper rail; and a lower rail in which lower unit cells each of which has a lower rail-concave part and a lower rail-convex part are consecutively repeatedly formed on a lower side of the sealing rail, wherein the lower rail-convex part and the lower rail-concave part of the second zipper rail are fastened to or unfastened from the lower rail-concave part and the lower rail-convex part of the first zipper rail, wherein each of the upper unit cell and the lower unit cell is shaped in a manner defined by:

a first circle and a first central circle are formed, wherein a diameter of the first central circle which is positioned in the center of the first circle is ⅓ of a diameter of the first circle;

a second circle and a second central circle are formed, wherein the second circle is in tangential contact with the first central circle, and a diameter of the second central circle which is positioned in a center of the second circle is ⅓ of a diameter of the second circle;

a third circle and a third central circle are formed, wherein the third circle is in tangential contact with the second central circle which is positioned in a center of the third circle, and a first center line connecting the centers of the first circle, the second circle and the third circle is linear;

a fourth circle, a fifth circle, a sixth circle and a second center line are formed, in the same way as the first to third circles and the first center line are formed, below the first to third circles;

nodes are formed on the first to sixth circles to form inflections points of a convex part or a concave part, wherein nodes comprising:

a first node at which the first circle and the first center line intersect;

a second node at which the first circle, the first center line and the second center circle intersect;

a third node at which the second circle, the first center line and the third center circle intersect;

a fourth node at which the third circle and the first center line intersect;

a fifth node at which the first circle and the fourth circle intersect;

a sixth node at which the first circle, the second circle, the fourth circle and the fifth circle intersect;

a seventh node at which the second circle, the third circle, the fifth circle and the sixth circle intersect;

an eighth node at which the third circle and the sixth circle intersect;

a ninth node inside the fourth circle, the ninth node to which the fifth node is connected;

a tenth node on a part of the fifth circle positioned inside of the fourth circle;

an eleventh node on a part of the fifth circle positioned inside of the sixth circle; and a twelfth node inside the sixth circle, the twelfth node to which the eight node is connected, wherein the first to fourth nodes are collinear on the first center line, the fifth to eighth nodes are collinear on the second center line, and an imaginary line connecting the seventh to twelfth nodes is linear, and the first to fourth nodes, the fifth to eighth nodes, and the seventh to twelfth nodes are parallel to each other;

the convex part is formed to form the upper unit cell, the convex part comprises a first convex part and a second convex part, wherein:

the first convex part is formed by forming a first arc that connects the first node and the second node, the first arc is connected down to the fifth node along the first circle, and the fifth node is connected to the ninth node; and the second convex part is formed by forming a second arc that connects the third node and the fourth node, the second arc is connected from the second node to the sixth node downward along the first circle, and the sixth node is connected to the tenth node along the fifth circle; and the concave part is formed to form the lower unit cell by forming a third arc connecting the tenth node and the eleventh node which is connected to the seventh node along the fifth circle, and the seventh node is connected to the third node along the third circle; and wherein the upper rail further includes a cover for shielding a fastening position of the upper rail-concave part and the upper rail-convex part.

4. The multi airtight type rail zipper of claim 1, wherein the first zipper rail and the second zipper rail are made of a flexible material that is elastically deformable, and a core made of a hard material is further provided in one or more convex parts of the upper rail-convex part, the sealing rail-convex part, and the lower rail-convex part.

5. The multi airtight type rail zipper of claim 2, wherein the first zipper rail and the second zipper rail are made of a flexible material that is elastically deformable, and a core made of a hard material is further provided in one or more convex parts of the upper rail-convex part, the sealing rail-convex part, and the lower rail-convex part.

6. The multi airtight type rail zipper of claim 3, wherein the first zipper rail and the second zipper rail are made of a flexible material that is elastically deformable, and a core made of a hard material is further provided in one or more convex parts of the upper rail-convex part, the sealing rail-convex part, and the lower rail-convex part.

* * * * *